US007314351B2

(12) United States Patent
Kuroda

(10) Patent No.: US 7,314,351 B2
(45) Date of Patent: Jan. 1, 2008

(54) FUEL SUPPLY PUMP CAPABLE OF LUBRICATING CAM BEARINGS

(75) Inventor: Akihiro Kuroda, Anjo (JP)

(73) Assignee: Denso Corporation, Kariya, Aichi-pref. (JP)

( * ) Notice: Subject to any disclaimer, the term of this patent is extended or adjusted under 35 U.S.C. 154(b) by 631 days.

(21) Appl. No.: 10/788,321

(22) Filed: Mar. 1, 2004

(65) Prior Publication Data

US 2004/0179950 A1 Sep. 16, 2004

(30) Foreign Application Priority Data

Mar. 11, 2003 (JP) ..... 2003-065589

(51) Int. Cl.
*F04B 19/00* (2006.01)

(52) U.S. Cl. ..... 417/251; 417/313

(58) Field of Classification Search ..... 417/251, 417/313, 252, 440, 441, 470, 53; 184/6.4, 184/6.5, 6.8

See application file for complete search history.

(56) References Cited

U.S. PATENT DOCUMENTS

| | | | | |
|---|---|---|---|---|
| 6,230,688 | B1 | 5/2001 | Faix et al. | |
| 6,615,799 | B2 * | 9/2003 | Mori et al. | 123/450 |
| 6,722,864 | B2 * | 4/2004 | Suzuki et al. | 417/470 |
| 6,895,936 | B2 * | 5/2005 | Kuroda | 123/446 |
| 7,207,319 | B2 * | 4/2007 | Utsumi | 123/446 |
| 2003/0029423 | A1 | 2/2003 | Bochland et al. | |
| 2003/0037768 | A1 | 2/2003 | Kanne et al. | |
| 2003/0089339 | A1 | 5/2003 | Schueler | |
| 2003/0101970 | A1 * | 6/2003 | Utsumi | 123/495 |
| 2004/0007214 | A1 | 1/2004 | Schmidl et al. | |
| 2004/0197216 | A1 * | 10/2004 | Kuroda | 417/470 |
| 2004/0208753 | A1 * | 10/2004 | Mori et al. | 417/244 |
| 2004/0247469 | A1 * | 12/2004 | Fassbender et al. | 417/441 |
| 2006/0169251 | A1 * | 8/2006 | Mori et al. | 123/446 |

FOREIGN PATENT DOCUMENTS

DE 10205186 A1 8/2003

(Continued)

OTHER PUBLICATIONS

EPO Examination Report, Application No. 04005693.9-2331, Mar. 14, 2006.

(Continued)

*Primary Examiner*—Anthony Stashick
*Assistant Examiner*—Vikansha Dwivedi
(74) *Attorney, Agent, or Firm*—Nixon & Vanderhye P.C.

(57) ABSTRACT

A fuel supply pump uses a low-pressure supply pump for pumping up a low-pressure fuel, and a pump element having a plunger for increasing pressure of the low-pressure fuel supplied by the low-pressure supply pump. Part of the low-pressure fuel discharged from the low-pressure supply pump is supplied to a pump cam chamber as a lubrication fuel for sliding portions in the pump cam chamber. Part of the lubrication fuel in the pump cam chamber is sucked in or supplied by the low-pressure supply pump from a fuel film portion. Therefore, the lubrication fuel can be forcibly supplied to the bearing portions using the low-pressure supply pump in a uniform flow rate to the bearing portions, thereby stabilizing lubricating conditions of the bearing portions.

11 Claims, 4 Drawing Sheets

FOREIGN PATENT DOCUMENTS

| | | | |
|---|---|---|---|
| DE | 10205187 | A1 | 8/2003 |
| EP | 1184568 | A2 | 3/2002 |
| EP | 1 298 307 | A2 | 2/2003 |
| EP | 1344932 | A2 | 9/2003 |
| JP | 06-249133 | | 6/1994 |
| JP | 2001-504920 | A | 4/2001 |
| JP | 2002-242794 | | 8/2002 |
| JP | 2002-322968 | | 8/2002 |
| JP | 2002-310039 | A1 | 10/2002 |

OTHER PUBLICATIONS

Japanese Office Action dated Jun. 13, 2006 (with English translation).

* cited by examiner

FUEL SUPPLY PUMP CAPABLE OF LUBRICATING CAM BEARINGS

BACKGROUND OF THE INVENTION

1. Field of the Invention

The present invention relates to a fuel supply pump for an internal combustion engine (hereinafter referred to as an engine).

2. Description of the Related Art

An accumulator fuel injection system as shown in FIG. 4 is conventionally used as a diesel engine fuel injection system. The accumulator fuel injection system includes an accumulator (common rail) 100, in which a high-pressure fuel, supplied under pressure by a fuel supply pump 101, is accumulated. The high-pressure fuel in the common rail 100 is injected into each cylinder of the diesel engine through a fuel injection valve (injector) 102.

A fuel supply pump 101 includes a low-pressure supply pump 103, pump elements, such as a plunger 104, a plunger drive means, etc. The fuel in a fuel tank 105 is pumped by the low-pressure supply pump 103 and is supplied to a pressure chamber 106. The fuel supplied to the pressure chamber 106 is increased to high pressure by the reciprocating motion of the plunger 104 and is supplied to the common rail 100 under pressure. The reciprocating motion of the plunger 104 is activated by the plunger drive means.

The plunger drive means includes a drive shaft (cam shaft) 107 connected to an engine crankshaft and rotatively driven by the engine, a cam 108 assembled eccentrically on the cam shaft 107, a cam ring 109 driven by the cam 108 through a metal bushing (not shown) and revolved (orbited) about the center of the cam shaft 107, etc. A sliding surface 110 of the cam ring 109 is kept in pressure contact with a sliding surface 112 of the plunger 104 by an urging means 111. The plunger 104 is reciprocated by the orbiting of the cam ring 109 and the pressure of the urging means 111. In the process, the sliding surface 112 of the plunger 104 slides over the sliding surface 110 of the cam ring 109.

By the rotation of the cam shaft 107, the low-pressure supply pump 103 sucks in the low-pressure fuel from the fuel tank 105 and discharges it to the pressure chamber 106.

In order to maintain the lubricity of a sliding portion between the plunger 104 and the cam ring 109, the low-pressure fuel discharged from the low-pressure supply pump 103 is supplied to the sliding portion. Also, the lubricity of a sliding portion in the plunger drive means, such as a sliding portion between a metal bushing and the cam 108, is improved (for example, Japanese Unexamined Patent Publication No. 2002-310039).

In a bearing portion of the cam shaft 107 or, especially, a portion adjacent to the low-pressure supply pump 103, on the other hand, the lubricity between a metal bushing 113 and the cam shaft 107 is maintained by the low-pressure fuel leaking from the low-pressure supply pump 103. The low-pressure fuel oil supplied by leakage, however, varies in flow rate thereof such that the lubricating conditions are liable to vary.

SUMMARY OF THE INVENTION

The object of this invention is to provide a fuel supply pump in which the lubricating conditions of the bearing portion of the drive shaft (cam shaft) do not vary.

According to a first aspect of the invention, there is provided a fuel supply pump comprising a sliding portion lubrication oil path for supplying part of the fuel discharged from a low-pressure supply pump to sliding portions between a plunger and a plunger drive means, and a bearing portion lubrication oil path for supplying to bearing portions of the drive shaft with the fuel supplied to the sliding portions between the plunger and the plunger drive means.

In this aspect of the invention, the low-pressure fuel can be forcibly supplied to the bearing portions of the drive shaft utilizing the discharge pressure of the low-pressure supply pump (the low-pressure fuel supplied to the bearing portions and the sliding portions is hereinafter referred to as the lubrication fuel) and, therefore the flow rate of the lubrication fuel supplied to the bearing portions does not vary and the lubricating conditions of the bearing portions can be stabilized.

According to a second aspect of the invention, there is provided a fuel supply pump in which the fuel supplied to the bearing portions of the drive shaft is sucked in by the low-pressure supply pump.

According to a third aspect of the invention, there is provided a fuel supply pump comprising a throttle arranged in the bearing portion lubrication path and restricting the flow rate of the fuel sucked in by the low-pressure supply pump from the bearing portions of the drive shaft.

Thus, the lubrication fuel can be prevented from being excessively sucked in by the low-pressure supply pump, and the temperature increase of the lubrication fuel can be suppressed.

According to a fourth aspect of the invention, there is provided a fuel supply pump, comprising a sliding portion lubrication oil path for supplying part of a fuel discharged from a low-pressure supply pump to sliding portions between a plunger and a plunger drive means, and a bearing portion lubrication oil path branching from the sliding portion lubrication oil path and supplying part of the fuel, flowing to the sliding portions between the plunger and the plunger drive means, to bearing portions of a drive shaft.

In this way, effects similar to those of the first embodiment can be obtained. Further, the lubrication fuel supplied to the bearing portions comes directly from a fuel tank and, therefore, is low in temperature. Therefore, the cooling effect can be increased.

According to a fifth aspect of the invention, there is provided a fuel supply pump, wherein the bearing portion lubrication oil path includes a throttle for restricting the flow rate of the fuel supplied to the bearing portions of the drive shaft.

The fuel supply pump according to a sixth aspect of the invention comprises: a bearing portion lubrication oil path for supplying part of a fuel discharged from a low-pressure supply pump to bearing portions of a drive shaft; a sliding portion lubrication oil path for supplying sliding portions between a plunger and a plunger drive means with the fuel supplied to the bearing portions of the drive shaft; and a throttle arranged in the bearing portion lubrication oil path and restricting the flow rate of the fuel supplied to the bearing portions of the drive shaft.

In this way, effects similar to those of the fourth embodiment can be obtained. Further, the flow paths returning to the fuel tank through the bearing portions and the sliding portions between the plunger and the plunger drive means can be combined into a single path, and, therefore, the number of the fuel paths can be reduced. Also, the provision of the throttle can restrict the flow rate of the lubrication fuel supplied.

The present invention may be more fully understood from the description of the preferred embodiments of the invention, as set forth below, together with the accompanying drawings.

DESCRIPTION OF THE PREFERRED EMBODIMENTS

Configuration of First Embodiment

Figure 1:
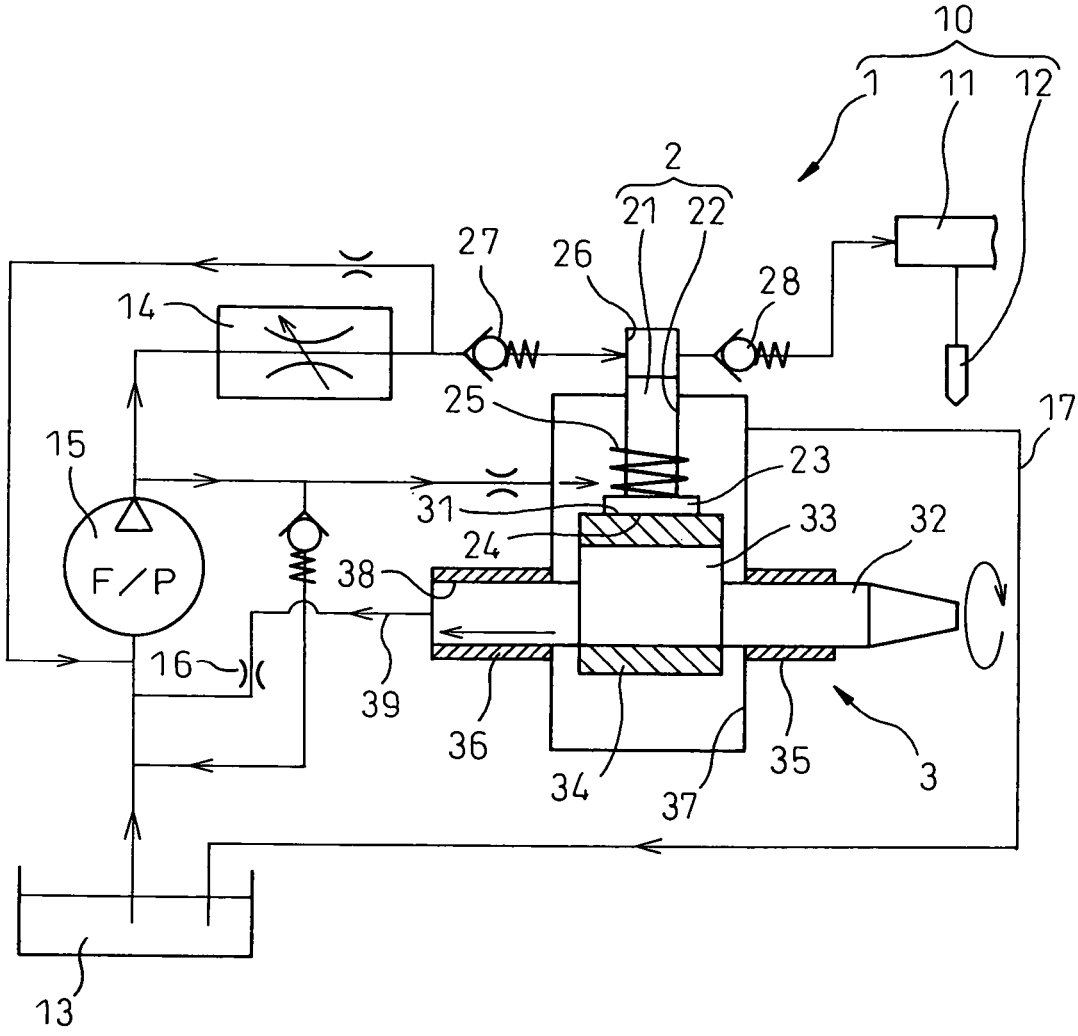
FIG. 1 is a diagram for explaining a fuel supply pump according to a first embodiment of the invention.

A first embodiment of the invention is explained with reference to FIG. 1. A fuel supply pump 1 according to the first embodiment is used with an accumulator fuel injection system.

An accumulator fuel injection system 10 to which the fuel supply pump 1 according to the invention is applied comprises a fuel supply pump 1, a common rail 11, an injector 12, etc. A low-pressure fuel sucked in from a fuel tank 13 is increased in pressure and discharged as a high-pressure fuel by the fuel supply pump 1. The common rail 11 accumulates the high-pressure fuel discharged from the fuel supply pump 1, and distributes it to the injector 12 of each cylinder of a diesel engine or the like mounted on a vehicle such as an automobile. The injector 12 supplies, by injecting, the high-pressure fuel to each cylinder of the engine at a predetermined timing for a predetermined length of time in response to a command from an engine control unit (not shown).

The fuel supply pump 1 includes a pump element 2, a metering valve 14, a low-pressure supply pump 15, a plunger drive means 3 (hereinafter referred to as the drive means 3), etc.

The pump element 2 including a plunger 21, a cylinder 22, etc. is the most important part exhibiting the function as a high-pressure supply pump for increasing the pressure of the low-pressure fuel to a high pressure and supplying the high-pressure fuel to the common rail 11.

The plunger 21, which reciprocates in the cylinder 22, increases the pressure of the low-pressure fuel and supplies a high-pressure fuel to the common rail 11. A plunger head 23 having a larger diameter than the cylinder 22 is formed at the end of the plunger 21 nearer to the drive means 3. The end surface of the plunger head 23 nearer to the drive means 3 is machined in a flat form and constitutes a sliding surface 24 with the drive means 3. The plunger head 23 is connected with a spring 25 for urging the plunger 21 toward the drive means 3. By the urging operation of the spring 25, the sliding surface 24 is brought into pressure contact with a sliding surface 31 of the drive means 3.

The cylinder 22 supports the plunger 21 so that the plunger 21 can reciprocate. A pressure chamber 26 is formed between an inner peripheral surface of the cylinder 22, an end surface of the plunger 21 farther to the driven means 3, etc. The low-pressure fuel introduced into the pressure chamber 26 is increased in pressure by the plunger 21. An inlet-side fuel path to the pressure chamber 26 and an outlet-side fuel path from the pressure chamber 26 have check valves 27 and 28, respectively, for blocking the reverse flow of the fuel.

The metering valve 14 is a normally-open solenoid valve, which by adjusting the opening degree (the lift amount of the valve body or the valve-port opening area) of a fuel path formed therein, controls the flow rate of the low-pressure fuel supplied from the low-pressure supply pump 15 to the pressure chamber 26. The opening degree of the fuel path is adjusted in accordance with an instruction of the engine control unit.

The low-pressure supply pump 15 is a feed pump for sucking in the low-pressure fuel from the fuel tank 13 and supplying it to the pressure chamber 26 through the metering valve 14. The low-pressure supply pump 15 is arranged at an end portion of a drive shaft 32 making up the drive means 3 and is driven by the driving force transmitted from the drive shaft 32.

The drive means 3 is a plunger drive means having the drive shaft 32 rotatively driven by the engine and reciprocating the plunger 21 in accordance with the rotation of the drive shaft 32. The drive means 3 includes the drive shaft (cam shaft) 32, a cam 33, a cam ring 34, etc. An end portion of the cam shaft 32 farther from the low-pressure supply pump 15 is connected to a crankshaft (not shown) of the engine and is rotatively driven by the engine.

The cam shaft 32 is accommodated in and supported by a pump housing (not shown) through metal bushings 35, 36. The metal bushing 35 is mounted on a part of the housing nearer to the crankshaft, while the metal bushing 36 is mounted on a part of the housing nearer to the low-pressure supply pump 15. An inner peripheral surface of the metal bushing 36 nearer to the low-pressure pump 15 and an outer peripheral surface of the cam shaft 32 make up a bearing portion of the cam shaft 32 (hereinafter simply referred to as the bearing portion). When the cam shaft 32 is rotatively driven by the engine, the outer peripheral surface of the cam shaft 32 slides on the inner peripheral surface of the metal bushing 36.

The cam 33 is a column having a circular section, is assembled eccentrically on the cam shaft 32, and revolves (orbits) about the center of the cam shaft 32 in operatively interlocked relation with the rotation of the cam shaft 32. The cam ring 34 is a tube with a substantially regular polygonal section, having a plurality of flat surfaces, formed on the outer surface of the tube and being in parallel to the axial center of the cam 33. A cam 33 is accommodated in the inside of the tube of the cam ring 34 through a metal bushing (not shown).

The flat surfaces formed on the outer surface of the cam ring 34 make up the sliding surface 31 on which the sliding surface 24 of the plunger head 23 slide. The plunger head 23 is urged toward the sliding surface 31 by the spring 25, so that the sliding surface 24 is kept in pressure contact with the siding surface 31. When the cam shaft 32 is rotatively driven, therefore, the cam ring 34 orbits about the center of the cam shaft 32 without changing the direction of each flat surface of the sliding surface 31. As a result, the plunger head 23 slides while relatively reciprocating back and forth on the sliding surface 31, in FIG. 1. Also, the outer peripheral surface of the cam 33 slides on the inner peripheral surface of the metal bushing inserted in the cam ring 34 (the sliding surface 24 of the plunger head 23, the sliding surface 31 of the cam ring 34, the outer peripheral surface of the cam 33 and the inner peripheral surface of the metal bushing inserted in the cam ring 34 are hereinafter referred to collectively as the sliding portion).

Next, lubricant paths for supplying the lubrication fuel to the bearing portions and the sliding portions are explained. First, a sliding portion lubricant path for supplying the lubrication fuel to the sliding portion includes a pump cam chamber 37, a fuel path connecting the pump cam chamber 37 and an outlet of the low-pressure supply pump 15, etc. The pump cam chamber 37 accommodates the plunger head 23, the spring 25, the cam 33, the cam ring 34, etc. Part of the low-pressure fuel discharged from the low-pressure supply pump 15 is supplied to the pump cam chamber 37 as a lubrication fuel, and all the sliding portions are immersed in the lubrication fuel. As a result, the lubricity of the sliding portions is maintained.

The bearing portion lubricant path for supplying the lubrication fuel to the bearing portions includes a fuel film portion 38, a fuel intake path 39, an orifice 16, etc. The fuel film portion 38 is formed in a minuscule gap between the inner peripheral surface of the metal bushing 36 and the outer peripheral surface of the cam shaft 32, and is filled with the lubrication fuel. The lubrication fuel in the pump cam chamber 37 flows into the fuel film portion 38 which communicates with the pump cam chamber 37. In the fuel film portion 38, the lubrication fuel is filled, as a film, to maintain the lubricity of the bearing portion.

The fuel intake path 39 is a fuel path for connecting the fuel film portion 38 and an inlet of the low-pressure supply pump 15. Thus, the low-pressure supply pump 15 constantly sucks in the lubrication fuel from the fuel film portion 38. The orifice 16 is arranged in the fuel intake path 39, and restricts the flow rate of the lubrication fuel sucked in from the fuel film portion 38 by the low-pressure supply pump 15. As a result, that part of the lubrication fuel supplied to the pump cam chamber 37 which fails to be sucked in by the low-pressure pump 15 passes through an overflow path 17 and returns to the fuel tank 13.

Function of First Embodiment

According to the first embodiment, part of the low-pressure fuel discharged from the low-pressure supply pump 15 is supplied to the pump cam chamber 37. The low-pressure fuel supplied to the pump cam chamber 37 is used as a lubrication fuel for the sliding portions. Part of the lubrication fuel in the pump cam chamber 37, on the other hand, is sucked in by the low-pressure supply pump 15 from the fuel film portion 38. The lubrication fuel sucked in by the low-pressure supply pump 15 is used as a lubrication fuel for the bearing portions.

Effects of First Embodiment

As described above, the low-pressure fuel discharged from the low-pressure supply pump 15 is supplied to the pump cam chamber 37 as a lubrication fuel for the sliding portion and, further, part of the lubrication fuel in the pump cam chamber 37 is sucked in by the low-pressure supply pump 15 from the fuel film portion 38. As a result, the lubrication fuel can be forcibly supplied to the bearing portions using the low-pressure supply pump 15. Thus, the lubrication fuel can be supplied to the bearing portions at a flow rate free of variations and, thereby, stabilizing the lubricating conditions of the bearing portions.

Further, the provision of the orifice 16 in the fuel intake path 39 prevents the lubrication fuel from being excessively sucked in by the low-pressure supply pump 15. As a result, the lubrication fuel in the pump cam chamber 37 can be prevented from increasing in temperature.

Specifically, without the flow rate restriction by the orifice 16 or the like, a major portion of the lubrication fuel would be sucked in by the low-pressure supply pump 15 and continue to circulate through the pump cam chamber 37, the fuel film portion 38 and the fuel intake path 39, with the probable result that the temperature of the lubrication fuel is increased by the heat generated in the sliding portions and the bearing portions. By restricting the circulation flow rate of the lubrication fuel by the orifice 16, on the other hand, the low-pressure fuel, low in temperature, from the fuel tank 13 can be sucked in a greater flow rate, thereby making it possible to prevent the lubrication fuel from increasing in temperature.

Second Embodiment

Figure 2:
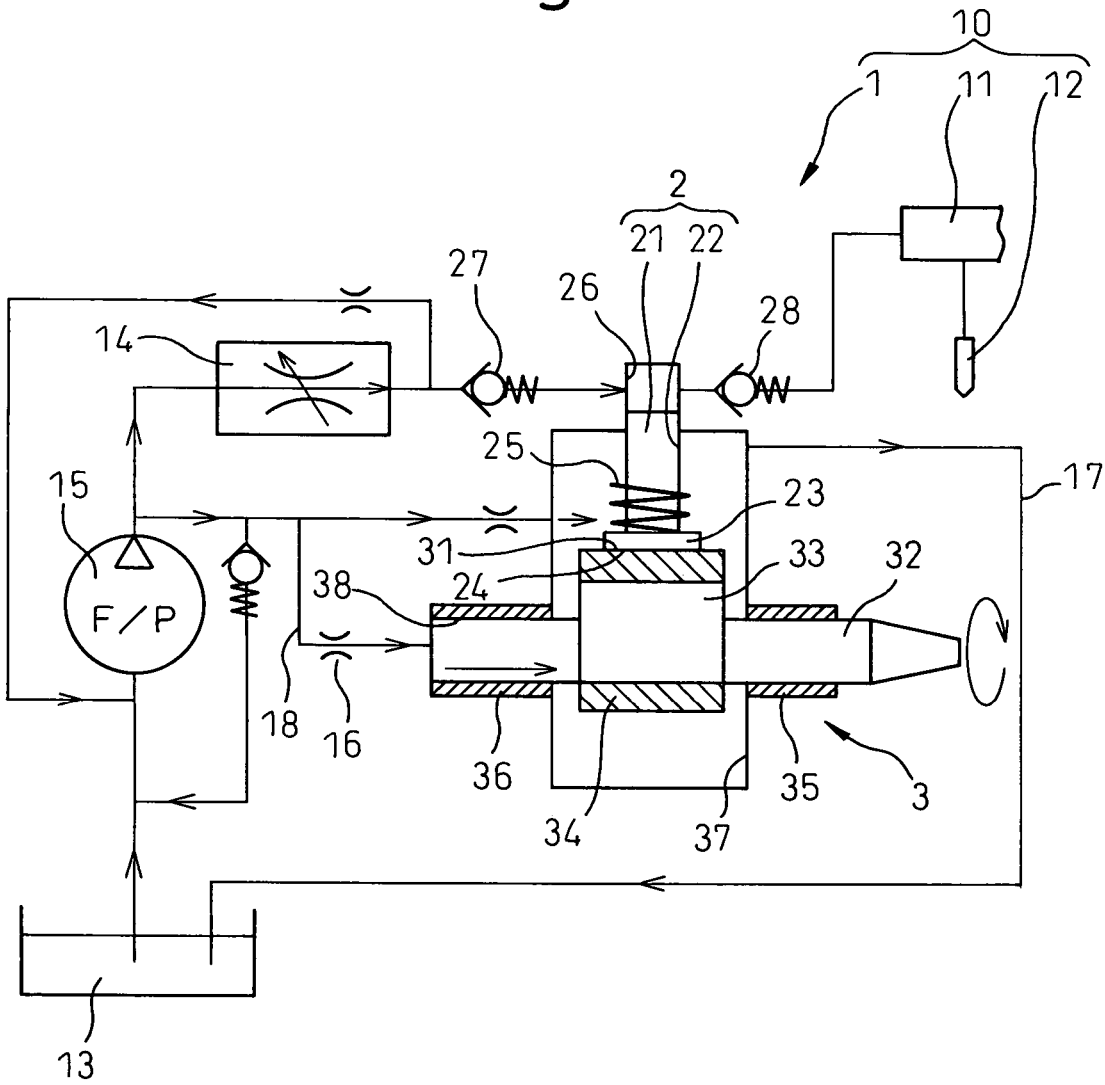
FIG. 2 is a diagram for explaining a fuel supply pump according to a second embodiment of the invention.

According to a second embodiment of the invention, a bearing portion lubricant path includes a fuel branch supply path 18, an orifice 16, a fuel film portion 38, etc. As in the first embodiment, a sliding portion lubricant path is so configured that part of the low-pressure fuel discharged from a low-pressure supply pump 15 is introduced to a pump cam chamber 37 as a lubrication fuel for the sliding portions. The fuel branch supply path 18, as shown in FIG. 2, branches from a fuel path leading from the low-pressure supply pump 15 to the pump cam chamber 37. A fuel path leading from the low-pressure supply pump 15 toward the pump cam chamber 37 constitutes a part of the sliding portion lubricant path.

Part of the lubrication fuel flowing toward the pump cam chamber 37 is led by the fuel branch supply path 18 to the fuel film portion 38 as a lubrication fuel for the bearing portions. The fuel branch supply path 18 has the orifice 16 for restricting the flow rate of the lubrication fuel discharged from the low-pressure supply pump 15 and flowing toward the fuel film portion 38, i.e. the bearing portions. The lubrication fuel led to the fuel film portion 38 flows into the pump cam chamber 37, and together with the lubrication fuel supplied directly to the pump cam chamber 37, i.e. the lubrication fuel for the sliding portion, returns to the fuel tank 13 through an overflow path 17.

Function of Second Embodiment

According to the second embodiment, part of the low-pressure fuel discharged from the low-pressure supply pump 15 toward the pump cam chamber 37, which branches and is led to the fuel film portion 38, is used as a lubrication fuel for the bearing portions.

Effects of Second Embodiment

As described above, part of the lubrication fuel discharged from the low-pressure supply pump 15 and flowing toward the pump cam chamber 37 is led to the fuel film portion 38 as a lubrication fuel for the bearing portions. As a result, the lubrication fuel can be forcibly supplied to the bearing portions using the low-pressure supply pump 15. Thus, the lubrication fuel can be supplied to the bearing portions a flow rate free of irregularities, thereby stabilizing the lubricating conditions of the bearing portions. Also, since the low-pressure fuel low in temperature in the fuel tank 13 is supplied directly to the bearing portions, the bearing portion can be cooled more effectively. Further, the provision of the orifice 16 in the fuel branch supply path 18 prevents the lubrication fuel from being supplied in an excessive amount to the bearing portions. In this way, the sliding portions are prevented from being insufficiently lubricated or insufficiently cooled.

Third Embodiment

Figure 3:
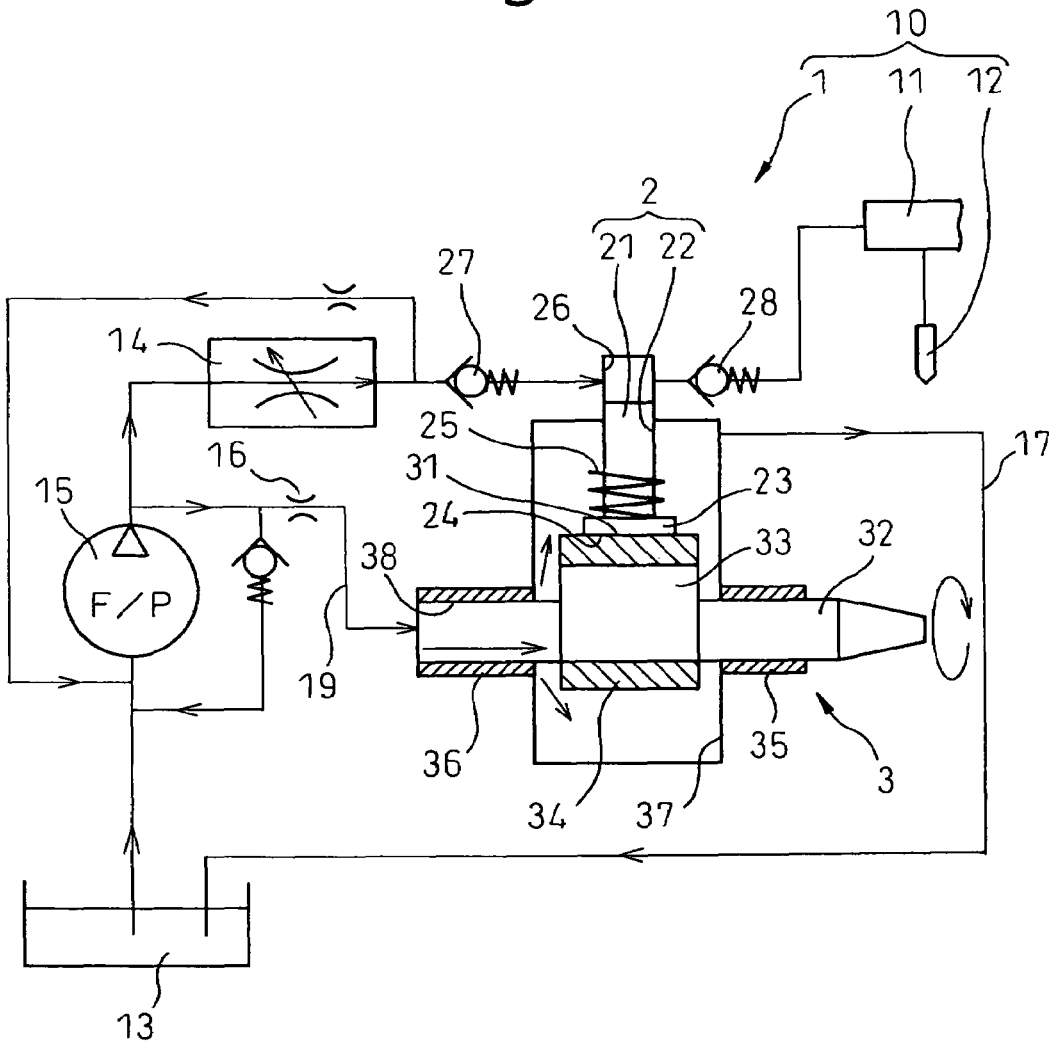
FIG. 3 is a diagram for explaining a fuel supply pump according to a third embodiment of the invention.
Figure 4:
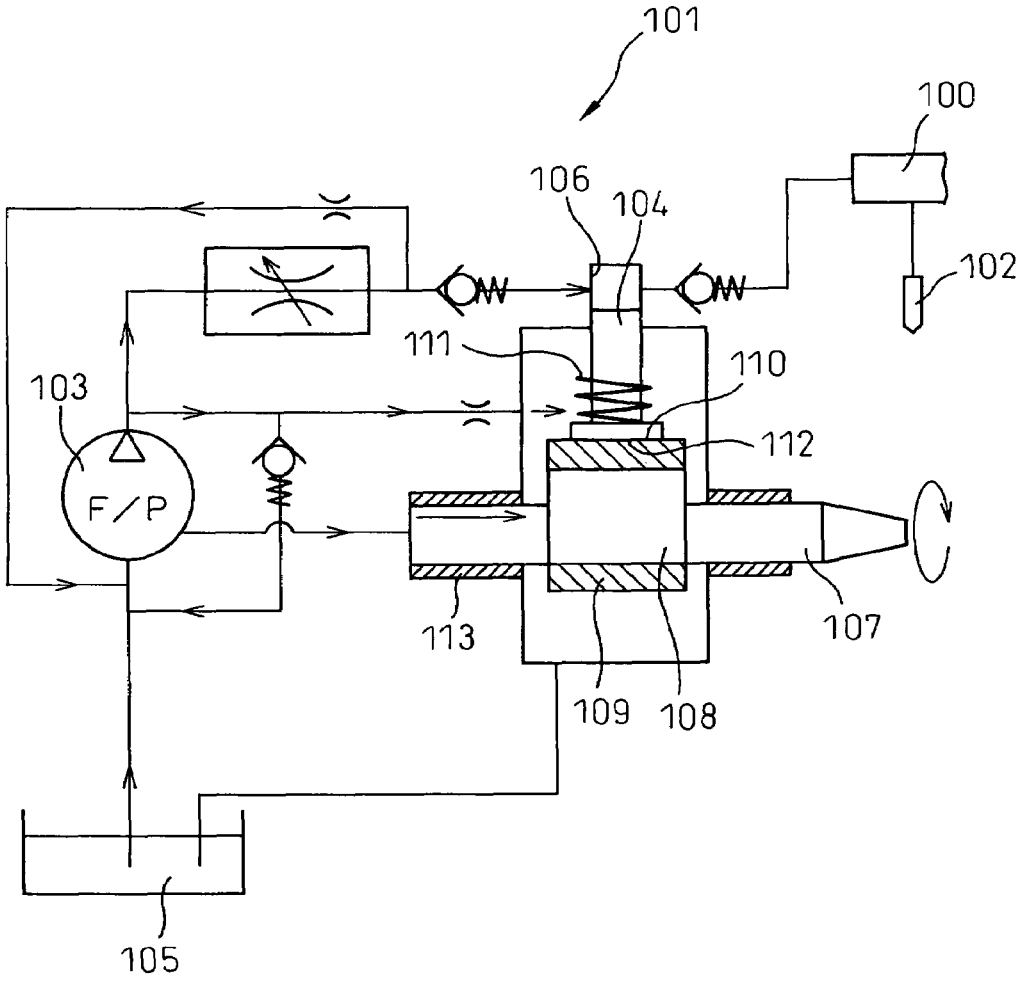
Fig. 4 PRIOR ART
FIG. 4 is a diagram for explaining a conventional fuel supply pump.

According to a third embodiment of the invention, a bearing portion lubricant path includes a fuel supply path 19, an orifice 16, a fuel film portion 38, etc. The fuel supply path 19, as shown in FIG. 3, is a fuel path whereby part of the low-pressure fuel discharged from a low-pressure supply pump 15 is led to a fuel film portion 38 as a lubrication fuel for the bearing portions and the sliding portions. The lubrication fuel, after flowing through the fuel film portion 38 and the pump cam chamber 37 in that order, is returned to a fuel tank 13 through an overflow path 17. The fuel supply path 19 has an orifice 16 for restricting the flow rate of the lubrication fuel flowing toward the fuel film portion 38 and the pump cam chamber 37.

Function of Third Embodiment

According to the third embodiment, the whole of the low-pressure fuel discharged from the low-pressure supply pump 15 and flowing toward the pump cam chamber 37 is first led to the fuel film portion 38 and is used as a lubrication fuel for the bearing portions. After that, the low-pressure fuel is supplied from the fuel film portion 38 into the pump cam chamber 37 and is used as a lubrication fuel for the sliding portions.

Effects of Third Embodiment

As described above, the lubrication fuel discharged from the low-pressure supply pump 15 and flowing toward the pump cam chamber 37 is wholly led first to the fuel film portion 38 as a lubrication fuel for the bearing portions. In this way, the lubrication fuel can be forcibly supplied to the bearing portions using the low-pressure supply pump 15. Therefore, the lubrication fuel can be supplied to the bearing portions always in a constant flow rate, and the lubricating conditions of the bearing portions can be stabilized. Further, since the low-pressure fuel low in a temperature is supplied from the fuel tank 13 to the bearing portions directly, the bearing portions can be cooled more effectively.

Also, the orifice 16 arranged in the fuel supply path 19 prevents the low-pressure fuel from flowing to the bearing portions excessively as a lubrication fuel. As a result, the short supply to the common rail 11 can be prevented. Further, in view of the fact that the flow paths returning from the low-pressure supply pump 15 to the fuel tank 13 through the bearing portions and the sliding portions can be combined into a single path, the exclusive fuel path for supplying the lubrication fuel to only the bearing portions can be eliminated.

Other Embodiments

In the embodiments described above, the fuel supply pump 1 according to this invention is applied to the accumulator fuel injection system 10 having the common rail 11. Alternatively, the invention may be applied to a jerk (pump) fuel injection system wherein the high-pressure fuel supplied under pressure by the fuel supply pump 1 is directly injected into each cylinder of an engine through an injector.

Also, in the embodiments described above, an orifice is used as a throttle for restricting the flow rate of the lubrication fuel. As an alternative, a choke may be used, or the throttle may be eliminated when the flow rate is low.

While the invention has been described by reference to specific embodiments chosen for the purposes of illustration, it should be apparent that numerous modifications could be made thereto, by those skilled in the art, without departing from the basic concept and scope of the invention.

The invention claimed is:

1. A fuel supply pump comprising:

a low-pressure supply pump for pumping up a fuel;

a pump element having a plunger for increasing pressure of the pumped up fuel, supplied into a pressure chamber by said low-pressure supply pump, to a high pressure;

a plunger drive means having a drive shaft for reciprocating said plunger in accordance with rotation of said drive shaft;

a sliding portion lubricant path whereby part of the fuel discharged from said low-pressure supply pump is supplied to at least a sliding portion between said plunger and said plunger drive means; and a bearing portion lubricant path whereby part of the fuel discharged from said low-pressure supply pump is also supplied to at least a bearing portion of said drive shaft.

2. A fuel supply pump according to claim 1, wherein the fuel supplied to said at least a bearing portion of said drive shaft is sucked in by said low-pressure supply pump.

3. A fuel supply pump according to claim 2, wherein a throttle for restricting the flow rate of the fuel sucked in by said low-pressure supply pump from at least the bearing portion of said drive shaft is arranged in said bearing portion lubricant path.

4. A fuel supply pump comprising:

a low-pressure supply pump for pumping up a fuel;

a pump element having a plunger for increasing pressure of the pumped up fuel, supplied into a pressure chamber by said low-pressure supply pump, to a high pressure;

a plunger drive means having a drive shaft for reciprocating said plunger in accordance with rotation of said drive shaft;

a sliding portion lubricant path whereby part of the fuel discharged from said low-pressure supply pump is supplied to at least a sliding portion between said plunger and said plunger drive means; and a bearing portion lubricant path branching from said sliding portion lubricant path, whereby part of the fuel flowing toward at least the sliding portion between said plunger and said plunger drive means is supplied to at least a bearing portion of said drive shaft.

5. A fuel supply pump according to claim 4, wherein a throttle for restricting the flow rate of the fuel supplied to at least the bearing portion of said drive shaft is arranged in said bearing portion lubricant path.

6. A fuel supply pump as claimed in claim 1 wherein:

part of the fuel discharged from said low-pressure supply pump is supplied to at least the bearing portion of said drive shaft; and the fuel supplied to at least the bearing portion of said drive shaft is supplied to at least the sliding portion between said plunger and said plunger drive means; and a throttle arranged in said bearing portion lubricant path and restricting the flow rate of the fuel supplied to at least the bearing portion of said drive shaft.

7. A method for pumping fuel in two stages through low and high pressure pumps while lubricating both sliding and bearing portions of the high pressure pump using lubricating fuel at a stable pressure output by the low pressure pump, said method comprising:

using a low pressure pump to controllably pressurize fuel to output fuel at a first pressure level;

using a high pressure pump with both sliding and bearing portions to increase fuel output from said low pressure pump to a second pressure level higher than said first pressure level; and passing at least part of fuel output from said low pressure pump along at least one lubricating path to supply lubricating fuel at stable pressure conditions to both said sliding and said bearing portions of the high pressure pump.

8. A method as in claim 7 wherein said at least one lubricating path includes a path passing serially through said sliding and said bearing portions.

9. A method as in claim 8 wherein lubricating fuel flows along said serial path from said low pressure pump first into said sliding portion and thence into said bearing portion.

10. A method as in claim 8 wherein said lubricating fuel flows along said serial path from said low pressure pump first into said bearing portion and thence into said sliding portion.

11. A method as in claim 7 wherein said at least one lubricating path includes parallel paths passing fuel in parallel to said sliding and said bearing portions.

* * * * *